United States Patent [19]

Lingnau

[11] 4,078,727

[45] Mar. 14, 1978

[54] ROTATABLE NOZZLE CONSTRUCTION

[75] Inventor: Horst Lingnau, Duisburg, Germany

[73] Assignee: Woma-Apparatebau W. Maasberg & Co. GmbH, Germany

[21] Appl. No.: 710,368

[22] Filed: Aug. 2, 1976

[30] Foreign Application Priority Data

Aug. 5, 1975 Germany ..... 2534884

[51] Int. Cl.[2] ..... B05B 3/06; B08B 3/02

[52] U.S. Cl. ..... 239/247; 134/179; 239/258; 239/261

[58] Field of Search ..... 239/225, 227, 247, 251, 239/252, 253, 256, 258, 261, 393, 394, 565, 587, 257; 134/167 R, 168 R, 176, 179; 118/323

[56] References Cited

U.S. PATENT DOCUMENTS

| | | | |
|---|---|---|---|
| 1,180,170 | 4/1916 | Marsh | 239/257 |
| 1,977,882 | 10/1934 | Lassen | 239/252 |
| 2,534,016 | 12/1950 | Grelson | 239/258 X |
| 2,787,499 | 4/1957 | Rolston | 239/258 X |
| 3,255,970 | 6/1966 | Saad | 239/227 |
| 3,357,644 | 12/1967 | Penfield et al. | 239/258 X |

FOREIGN PATENT DOCUMENTS

| | | | |
|---|---|---|---|
| 4,061 | 10/1927 | Australia | 239/258 |
| 145,864 | 1/1936 | Austria | 239/247 |

*Primary Examiner*—John J. Love

*Assistant Examiner*—Andres Kashnikow

*Attorney, Agent, or Firm*—McGlew and Tuttle

[57] ABSTRACT

A rotatable nozzle construction comprises a fixed hollow shaft which has a passage extending therethrough for the flow of the fluid. The distributor head is rotatably mounted on the shaft and it has at least one radially extending distributor head flow passage with an inner end which communicates with a radially extending portion of the shaft flow passage and an outer end which communicates with an annular passage defined around the periphery of a nozzle holder which is rotatably mounted at the periphery of the distributor head. The nozzle holder includes a generally radially extending distributor flow passage which terminates in a nozzle discharge which is at right angles to the axis of the shaft. The nozzle holder may be rotated on the distributor head so as to position the nozzle at any desired angle and the nozzle holder may be locked in the selected position. When the nozzle is arranged at an angle to the axis of the distributor head flow passage or at an angle from the radial line of the fixed shaft the force of discharge of the fluid will effect rotation of the distributor head. A second nozzle holder may be rotatably mounted on the distributor head at a diametrically opposite location from the first nozzle holder and the nozzles may be oriented in respective opposite directions to effect an arrangement of flow discharge to produce a turning couple on the distributor head.

6 Claims, 2 Drawing Figures

ROTATABLE NOZZLE CONSTRUCTION

BACKGROUND OF THE INVENTION

1. Field of the Invention

This invention relates in general to the construction of fluid discharge nozzles and in particular to a new and useful rotary nozzle construction which includes a distributor head rotatably mounted on a fixed hollow shaft which has a distributor head flow passage communicating with a flow passage through the shaft and which provides a mounting for at least one rotatable nozzle holder having a flow passage through the nozzle holder which communicates with the flow passage through the distributor head and the flow passage in the shaft and a nozzle discharge which may be oriented at an angle perpendicular to the axis of the shaft and rotated on its associated distributor head to position it at a selected angle for effecting a turning couple on the distributor head to cause it to rotate during the discharge of a fluid therefrom.

2. Description of the Prior Art

The present invention relates to a drive head for at least one mon-orbi-axially rotating nozzle. The nozzles serve the purposes of, for example, cleaning, drilling, cooling, etc. and the pressurized fluid may be a cleaning, drilling, cooling, etc. liquid. Mon- or biaxial rotary motion of the nozzle or nozzles means a rotary motion about a main axis.

In a known cleaning device, the fixed supply connection for the cleaning fluid carriers a revolving nozzle head. The nozzle head is supported on a housing with the interposition of bevel gears. In addition, a hollow shaft is provided serving both as a bearing shaft for the nozzle head and as a drive shaft for a liquid pump. Not only the mounting of the hollow shaft is relatively complicated but also the mounting of the pump between the supply connection and the revolving nozzle head. In addition, a rotary motion of the rotary nozzles perpendicular to the longitudinal axis of the hollow shaft is sought, in order to obtain, with the interposition of the bevel gearing, the rotation of the hollow shaft and, thereby, the drive of the liquid pump. The result is a relatively expensive construction. This is true particularly in view of the necessity for a liquid pump which is provided for the control of the speed of rotation.

SUMMARY OF THE INVENTION

The present invention is directed to a drive head for mon- or bi-axially rotating nozzles which is particularly simple in design and makes it possible, with the omission of an otherwise necessary liquid pump, to control the speed between zero and a predetermined maximum.

The problem is solved, in accordance with the invention, by providing that the at least one nozzle is mounted for rotation in the distributor head and in the plane perpendicular to the hollow shaft and is continuously adjustable to any angular position and lockable therein.

With a rotary mounting of the nozzle or nozzles, it is not difficult to adjust the line of action of the momentum originating in the nozzle, in a manner such that the driving moment of the nozzle produced by the effort arm between the nozzle and the axis of rotation of the distributor head can be continuously adjusted between zero and a predetermined maximum. The zero adjustment is given by the coincidence of the line of action of the momentum and the effort arm. The maximum adjustment is obtained when the line of action of the momentum and the effort arm form a right angle. Between these two extreme positions, any drive torque of the nozzle can be adjusted simply and with a precision such that a stable equilibrium and a definite characteristic can be obtained. As a result, a speed control without a liquid pump is obtained by the continuous adjustment of the drive torque of the nozzle.

The invention provides a construction in which the distributor head is designed as a wing or ring which is centrally mounted for rotation on the hollow fluid supply shaft and carries, on either end of the wing, a rotatably mounted nozzle, the nozzles of respective ends being oriented in mutually opposite directions. This arrangement of the nozzles doubles their drive torque, starting from the zero position. Preferably, the nozzles are spaced from the axis of rotation of the distributor head equidistantly. In addition, the invention teaches that the distributor head comprises two further nozzles which operate, for example, as cleaning nozzles and which are located on an axis which is perpendicular to the longitudinal axis of the wing and intersects with the same in the axis of rotation of the distributor head. These two nozzles, which are not adjustable, cannot be used for producing a drive torque and, consequently, only support, for example, the cleansing effect of the inventive drive head in cases where the head is used, for example, as a cleansing device for cleaning inside surfaces of containers or tubes. These nozzles always extend in a line of action having no effort arm. In a preferred embodiment of the invention, of separate importance, the rotary mounting of the nozzles can easily be obtained by providing that the nozzles are received in a nozzle holder and the nozzle holders are mounted for rotation on the distributor head. In accordance with the invention, the distributor head and the nozzle holders are provided with flow bores for the pressurized fluid, which are in permanent communication with each other. To this end, the nozzle holders are provided with annular passages which are associated with the flow bores of the nozzle holders and of the distributor head and which insure the supply of the pressurized fluid to the nozzles in any adjusted angular position of the nozzles. Thus, the drive torque of the nozzles is varied only by the rotary motion of the nozzles and/or by the pressurized-fluid supply to the nozzles. Locking means, for example, setscrews, are associated with the nozzle holders so that the nozzles cannot become angularly misadjusted of themselves.

The advantages obtained by the invention are to be seen primarily in the provision of a drive head for mon- or bi-axially rotating nozzles, which may serve, for example, as a device for cleaning inside surfaces of containers and tubes of any kind, and which is particularly simple in design and suitable for operation, and makes it possible to control, particularly, the speed of rotation between zero and a predetermined maximum, with the omission of a liquid pump. The inventive device can completely dispense with a hydraulic braking, rather a momentum control is used through which the force component, effective at the end of the associated effort arm, is continuously varied. Thereby, it is easy to provide for definite working points. Besides, if necessary, a hydraulic braking may also be used.

Accordingly it is an object of the invention to provide a novel construction which comprises a fixed hollow shaft which has a shaft flow passage therethrough which is connected radially outwardly into a distributor flow passage of a distributor head which is rotatably mounted on the shaft and which in turn connects to a nozzle flow passage defined through at least one nozzle holder which is rotatably mounted on the distributor head at a spaced location from the axis of the shaft and which has a discharge nozzle receiving the flow from the nozzle flow passage which may be oriented to discharge at substantially right angles to the axis of the shaft and which may be oriented by rotation of the nozzle holder at any selected angle in respect to the axis of the associated distributor head in order to produce a discharge flow at an angle to effect rotation of the distributor head around the shaft.

A further object of the invention is to provide a novel construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

GENERAL DESCRIPTION OF THE PREFERRED EMBODIMENT

Figure 1:
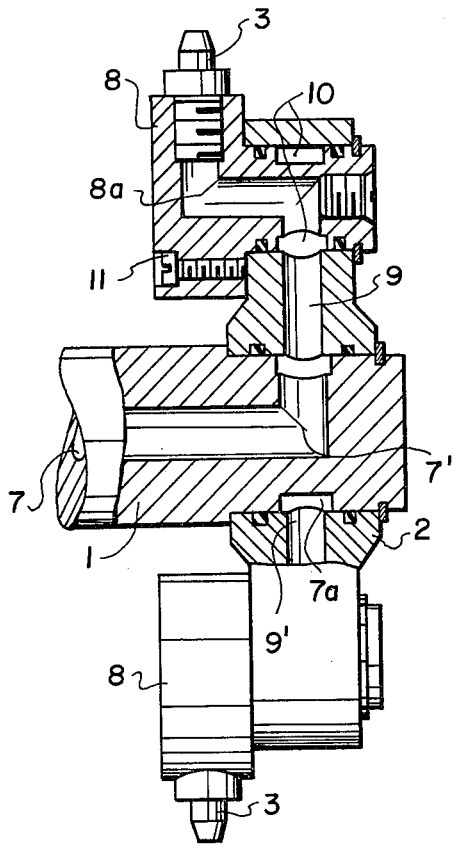
FIG. 1 is a partial elevational and partial sectional view of a cleaning nozzle constructed in accordance with the invention.

Referring to the drawings in particular the invention therein compriss a nozzle construction or drive head for a mon- or bi-axially rotating nozzle which in the embodiment shown comprises a cleaning nozzle for cleaning inside surfaces of containers and tubes of any kind.

In accordance with the invention, the nozzle includes a fixed hollow shaft 1 having a fluid flow passage 7 therethrough which includes a portion which extends radially and communicates with an annular passage 7*a* which is defined around the periphery of the shaft 1 and which is covered by a distributor head 2 of ring shaped configuration which is rotatably mounted on the shaft. The distributor head 2 includes two diametrically opposite radially extending flow passages 9 and 9' which communicate at their inner radial ends with the annular passage 7*a* and communicate at their outer radial ends with an annular passage 10 which is defined in a nozzle holder 8. The nozzle holder 8 is of generally cylindrical configuration and it includes a generally radially extending nozzle flow passage 8*a* which communicates at its radial inner end with the annular passage 10. The outer radial end of the passage 8*a* of the distributor head 8 communicates with a nozzle 3 having a discharge which in the embodiment illustrated is oriented to discharge perpendicular to the axis 7' of the fixed hollow shaft 1.

Figure 2:
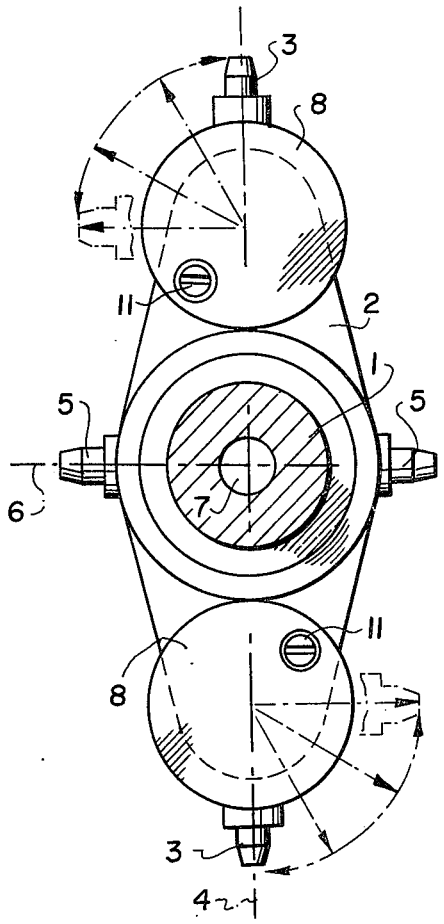
FIG. 2 is a partial sectional view and front elevational view of the nozzle shown in FIG. 1.

With the nozzle 3 in operation, that is discharging fluid, the distributor head rotates about the hollow shaft 1. The nozzle 3 is mounted on the distributor head for a revolving motion in a plane which is perpendicular to the axis of the hollow shaft and it is adapted to be adjusted to any angular position and locked therein as indicated by the dot and dash arrows shown in FIG. 2. The arrows also indicate the direction of some of the possible lines of action of the discharging jet and they indicate the possibility for the continuous adjustment of the drive torque of the nozzle between zero in which the nozzle is oriented as shown in solid line position to discharge radially outwardly from the shaft to a maximum in which it would be oriented substantially at right angles to the axis of the longitudinal axis 4 of the distributor head 2.

The distributor head 2 is designed as a rotating wing which is centrally mounted for rotation on the hollow shaft 1 and which advantageously carries on each of its two ends a rotatably mounted nozzle 3. The two nozzles 3 may be oriented to face in respective opposite directions to produce a maximum rotational force couple or they may be oriented to discharge radially outwardly coincident with the longitudinal axis 4 of the wing at which there will be no rotational momentum. With each of the lines of discharge action forming a right angle to the longitudinal axis 4 of the associated distributor head 2 the drive torque of the nozzles will be at the maximum.

The distributor head 2 may comprise any number of rotating nozzle holders 8. In addition it may comprise two further nozzles which operate as cleaning nozzles namely the nozzles 5 provided in fixed positions oriented along the axis 6 which is perpendicular to the longitudinal axis 4 of the distributor head 2 and intersects with the axis 7' of the fixed shaft 1 which also comprises the axis of rotation of the distributor head.

Each nozzle holder 8 advantageously includes locking means in the form of a set screw 11 which is threaded into the nozzle holder and which may be brought to bear against the distributor head 2 to lock the nozzle holder in an adjusted rotational position.

While a specific embodiment of the invention has been shown and described in detail to illustrate the application of the principles of the invention, it will be understood that the invention may be embodied otherwise without departing from such principles.

What is claimed is:

1. A nozzle construction comprising a fixed hollow shaft having a shaft flow passage therethrough, a distributor head having an annular hub portion rotatably mounted on said shaft and having two oppositely and radially extending arms each with a distributor head flow passage defined therethrough, first means defining an annular communicating flow passage between the shaft flow passage and said distributor head flow passage to permit communication of said flow passages during rotation of said distributor head around said shaft, at least one nozzle holder rotatably mounted on said distributor head at a spaced location from and about an axis substantially parallel to the axis of said shaft and having a discharge nozzle flow passage therethrough and a nozzle discharge with an axis disposed at substantially right angles to the axis of said shaft and said distributor head, second annular passage means defined between said distributor head and said nozzle holder to permit communication between the discharge nozzle flow passage and the distributor head flow passage during rotation of said nozzle holder relative to said distributor head, said nozzle holder being rotatable on its associated arm of said distributor head and being selectively orientable at an angle in respect to the associated distributor head flow discharge passage and locking means defined between said distributor head and said nozzle holder to fix said nozzle holder against rotation in respect to said distributor head after said nozzle discharge is oriented at a selected orientation.

2. A drive head for cleaning receptacles, ducts, tubes, etc. comprising a fixed hollow shaft having a shaft flow passage therethrough with an axially extending portion and an annular peripheral portion, a distributor head having an annular hub portion rotatably mounted on said shaft and having at least one radially extending distributor head flow passage defined therethrough and having an inner end communicating with said shaft flow passage annular portion, and an outer end, at least one nozzle holder rotatably mounted on said distributor head at a spaced location from and about an axis substantially parallel to the axis of said shaft and having a discharge nozzle flow passage therethrough and a nozzle discharge with an axis disposed at substantially right angles to the axis of said shaft and said distributor head, said nozzle head being rotatable to selectively orient said nozzle discharge at a selected angle in respect to the axis of the associated distributor head flow passage, said distributor head being rotated on said hollow shaft upon admitting pressurized fluid into said shaft flow passage, said distributor head flow passage and said discharge nozzle flow passage, and means for locking said rotatable nozzle holder at a selected position in respect to said distributor head.

3. A nozzle construction according to claim 2, wherein said distributor head includes two radially outwardly extending arm portions and a nozzle holder rotatably supported at the outer end of each arm portion, said nozzle holders being rotatable to orient the nozzles in respective opposite directions.

4. A nozzle construction according to claim 2, including at least one additional nozzle on said distributor head comprising a cleaning nozzle which is fixedly mounted and which has a nozzle discharge communicating with said distributor head flow passage.

5. A nozzle construction according to claim 4, wherein said distributor head includes first and second diametrically oppositely extending arm portions with a nozzle holder mounted in each of said arm portions and being rotatable therein and means for locking each one of the nozzle holders at a selected rotational position.

6. A nozzle construction according to claim 2, wherein said locking means for locking said nozzle holder on said distributor head in a fixed angular position comprises a set screw threaded into said nozzle holder and engageable with said distributor head.

* * * * *